US008430724B2

(12) United States Patent
Heilian et al.

(10) Patent No.: US 8,430,724 B2
(45) Date of Patent: Apr. 30, 2013

(54) SURFACE CLEANING SYSTEM AND METHOD

(75) Inventors: Paoting Jerry Heilian, La Habra, CA (US); Tsai Guan-Chang, Changhua (TW); Steven Levy, Commack, NY (US)

(73) Assignees: Total Import Solutions, Inc., La Habra, CA (US); Tri-Plex Technical Services, Ltd., Freeburg, IL (US)

( * ) Notice: Subject to any disclaimer, the term of this patent is extended or adjusted under 35 U.S.C. 154(b) by 0 days.

(21) Appl. No.: 13/213,182

(22) Filed: Aug. 19, 2011

(65) Prior Publication Data

US 2013/0045662 A1 Feb. 21, 2013

(51) Int. Cl.
*B24B 23/02* (2006.01)
*B24B 15/00* (2006.01)

(52) U.S. Cl.
USPC ..... 451/359; 15/229.11; 51/297; 51/298; 451/495; 451/525; 451/538; 451/539

(58) Field of Classification Search ..... 15/209.1, 15/244.1, 244.4, 229.11; 51/295, 297, 298, 51/299, 300, 307, 308, 309; 451/344, 354, 451/451/356, 357, 358, 359, 495, 533, 523, 451/524, 525, 538, 539
See application file for complete search history.

(56) References Cited

U.S. PATENT DOCUMENTS

| | | | | |
|---|---|---|---|---|
| 3,785,102 | A * | 1/1974 | Amos | 15/215 |
| 4,215,516 | A * | 8/1980 | Huschle et al. | 451/531 |
| 4,822,669 | A * | 4/1989 | Roga | 442/373 |
| 5,109,638 | A * | 5/1992 | Kime, Jr. | 451/539 |
| 6,685,376 | B2 * | 2/2004 | Weihrauch | 401/196 |
| 2004/0261209 | A1 * | 12/2004 | McKay | 15/215 |
| 2008/0098546 | A1 * | 5/2008 | Warmka et al. | 15/104.94 |
| 2012/0094579 | A1 * | 4/2012 | Starling | 451/28 |

* cited by examiner

*Primary Examiner* — Timothy V Eley
(74) *Attorney, Agent, or Firm* — Senniger Powers LLP

(57) ABSTRACT

A surface cleaning system includes a retainer having a non-absorbing retaining surface and a surface cleaning compound retained at the retaining surface of the retainer and formed a cleaning surface overlapped thereat. The surface cleaning compound is a polymer having high density and high adhesive ability for removing imbedded contaminants from a working surface and grabbing the contaminants therefrom. The retainer is made of non-absorbing material that prevents lubricant and the surface cleaning compound being absorbed through the retainer.

9 Claims, 7 Drawing Sheets

SURFACE CLEANING SYSTEM AND METHOD

BACKGROUND

1. Field of the Invention

The present invention relates to a surface cleaning tool. More particularly, the present invention relates to a surface polishing system and method for efficiently removing stain, including high adhesive substance, from a surface, especially a surface of an automobile.

2. Discussion of the Related Art

Generally speaking, when an object is placed at an outdoor area for a certain time, the surface of the object will be contaminated by dust, sands, tiny metals, and/or other natural and manmade particles.

For example, when a car is parked outdoors for a certain time, the surface of the car will be contaminated by industrial pollution, over-spraying, insects, acid rain, wherein contaminants at the surface can be natural contaminants and/or manmade contaminants. The owner of the car may simply clean the car surface by mixing water with detergent in order to wash away the particles on the car surface. However, water can only remove particles stayed on the car surface but fails to remove particles being highly adhered on the car surface. The particles with high adhesive ability refer as bonded contaminants on the car surface. The surface evaluation can be simply done by inspecting the car surface visually as well as by physically touching the surface with one's hand. Often, the sense of touch can reveal defects the eyes cannot see. Without the bond contaminants, the car surface should feel as smooth as a glass surface. When you feel the irregularities on the car surface, the surface is contaminated and the bond contaminants must be removed before polishing or waxing.

Conventionally, the bond contaminants can be removed by "deep" cleaning the car surface during polishing the car surface via compound or sand paper. When the compound or sand paper is applied to the car surface, the abrasive surface will direct contact with the car surface to remove the bond contaminants. The abrasive surface, however, will be in direct contact with the protective coating of the car surface as well. As a result, the protective coating will also be damaged during the "deep" cleaning operation by using compound or sand paper.

Another conventional way to clean the car surface is by using clay article, wherein clay article is a paint and body product to remove bond contaminants while protecting the paint from harm. Lubricant, such as water, must be applied on the car surface before the clay article is glided across the lubricated area, wherein the clay article will grab the bond contaminants on the car surface. The advantages of this hand-sized clay article are easy to use even the car owner can do-it-yourself, effectively removing bond contaminants from the car surface without causing scratches, and requiring relatively less polishing force applied to the car surface. The clay article, however, can be worked on a relatively small area at one time. Therefore, the cleaning operation will take much longer time to complete detailing the entire car surface. The clay article must be kept folding with a new clean surface to glide on the car surface. Otherwise, the bond contaminants grabbed by the clay article will scratch on the car surface. When the clay article is dropped on the ground, the clay article must be thrown away because the clay article will pick up any dirt off of the ground and transfer it to the car surface and to scratch the car surface. The improper use of the clay article will cause more damages to the car surface than merely leaving the bond contaminants being left untreated.

An enhanced clay article product seen on the market generally comprises a clay article mounted on a sponge body, wherein the user is able to hold the sponge body to ensure an even polishing force being exerted at the clay article on the car surface. The clay article is generally absorbed by the sponge body to form a clay portion, however, only the clay article at the surface of the sponge body will be used. The clay article absorbed into the sponge body will be useless. This clay article product can be considered as a disposable product that the sponge body must be disposed once the clay surface is used up. The sponge body will also absorb water as the lubricant during the polishing operation. The efficiency of this clay article will be minimized without sufficient lubricant applying on the car surface. Therefore, the user must keep on applying water on the car surface during polishing operation. It not only wastes lots of clay articles and water but also causes pollution by disposing the sponge body with unused clay articles.

BRIEF SUMMARY OF THE INVENTION

The present invention overcomes the above mentioned drawbacks and limitation by configuring a surface cleaning system.

The primary objective of the present invention is that the surface cleaning system can efficiently remove stain, including high adhesive substance, from a surface, especially a surface of an automobile, without damaging the surface.

The surface cleaning system comprises a retainer having a non-absorbing retaining surface and a surface cleaning compound retained at the retaining surface of the retainer and formed a cleaning surface overlapped thereat.

The surface cleaning compound is a polymer having high density and high adhesive ability for removing imbedded contaminants from a working surface and grabbing the contaminants therefrom.

The retainer is made of non-absorbing material that prevents lubricant and the surface cleaning compound being absorbed through the retainer. Therefore, another objective of the present invention is that a thin layer of surface cleaning compound can be used for cleaning the working surface to minimize the waste of the surface cleaning compound being absorbed through and unused by the retainer and to minimize the use of lubricant being absorbed through the retainer.

Another objective of the present invention is that a plurality of contaminant collecting grooves is formed at the cleaning surface to collect contaminants being grabbed by the surface cleaning compound in order to prevent the contaminants accumulated by the surface cleaning compound to scratch the working surface.

Another objective of the present invention is that a compressible body is coupled with the retainer to enable a compressible force being evenly applied at the cleaning surface to clean the working surface. The retainer can be detached from the compressible body that enables the compressible body being re-used.

Another objective of the present invention is that the cleaning operation can be completed by either by hand operation or machine operation. The user is able to select the compressible body being coupled with a hand held actuator for hand operation or a machine buffering device for machine operation.

For a more complete understanding of the present invention with its objectives and distinctive features and advantages, reference is now made to the following specification and to the accompanying drawings.

BRIEF DESCRIPTION OF THE DRAWING(S)

DETAILED DESCRIPTION OF THE INVENTION

In accordance with a preferred embodiment of the present invention, the present invention provides a surface cleaning system and method which can efficiently remove imbedded contaminants such as stain or high adhesive substance, from a working surface without damaging the working surface. The working surface refers to but are not limited to a surface of an automobile, a boat, a truck, a recreational vehicle (RV), an ATV, a train, a plane, or motorcycle, in which the surface especially refers to a painted surface or a surface with protective coating such as clear coat. In addition, the working surface also refers to a glass surface. It is appreciated that the working surface can be a surface of solar panel, equipment, tools, leather or polished wood surfaces.

The method of surface cleaning is composed of the steps of selecting an applicator 100 and affixing a cleaning head 200 at the applicator 100. The applicator 100 can be a machine in which the cleaning process can be performed by machine as in FIG. 1. Or, the applicator 100 can be a hand held device in which the cleaning process can be manually performed by the user's hand as in FIG. 5.

Figure 1:
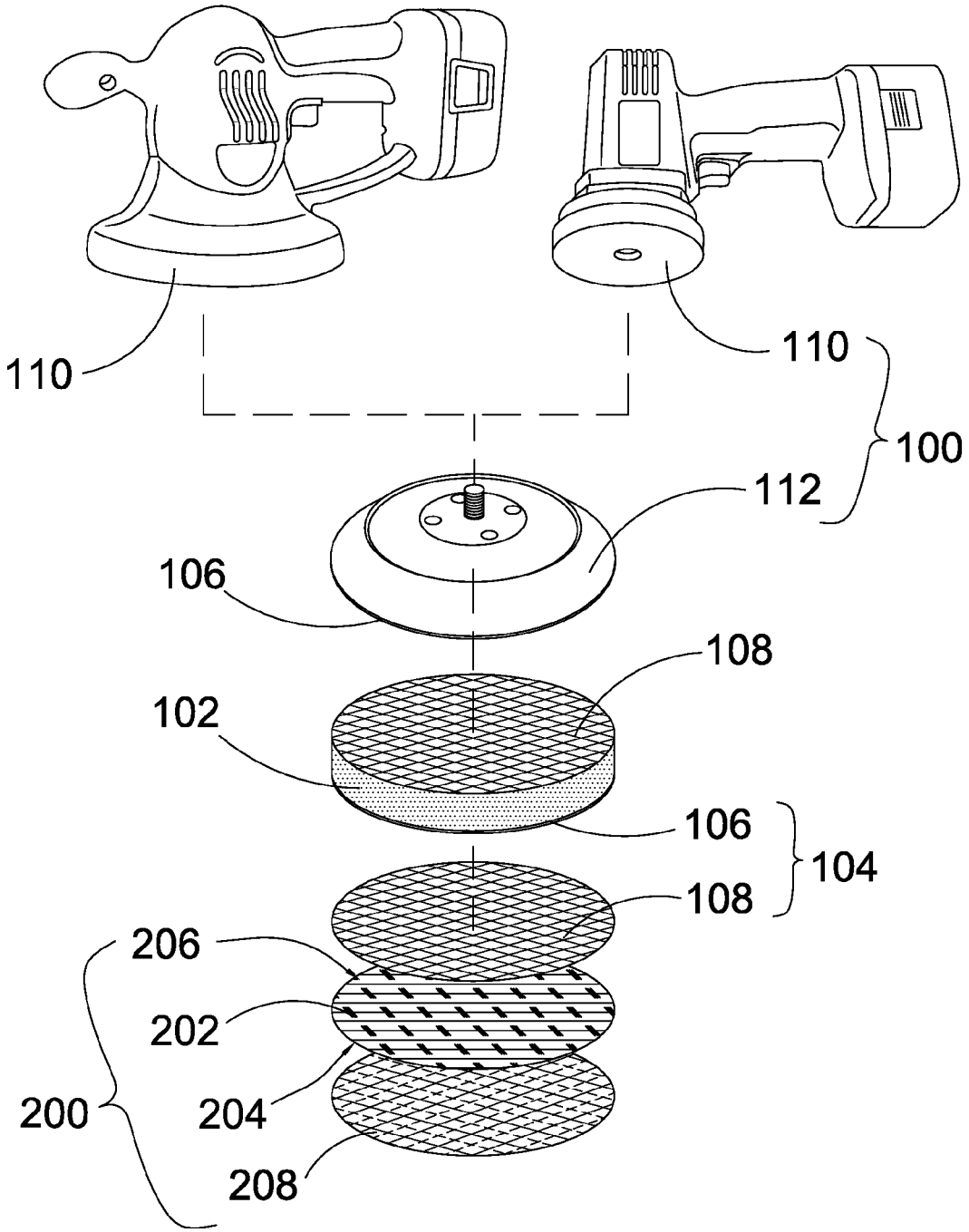
FIG. 1 is a schematic view of a surface cleaning system in accordance with the present invention, showing the applicator being configured as a machine applicator.
Figure 2:
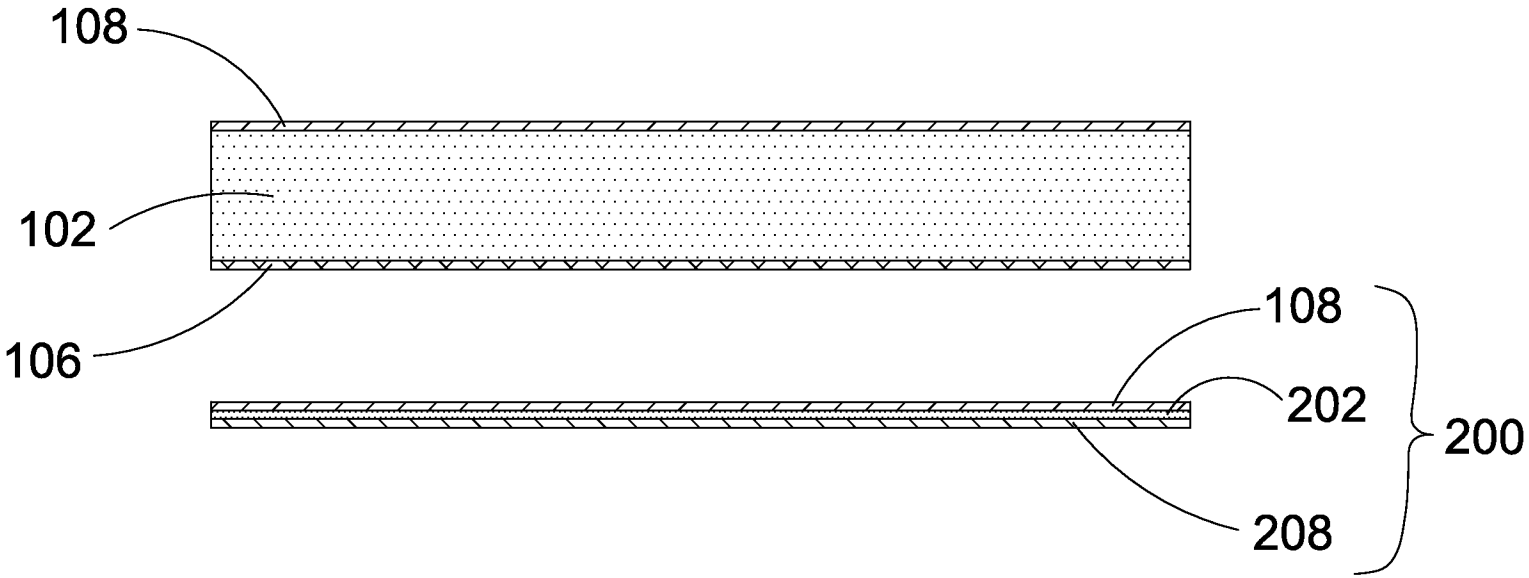
FIG. 2 is a sectional view of a cleaning head of the surface cleaning system in accordance with the present invention, showing the cleaning head detachably attached to the compressible body.

FIGS. 1 and 2 depict the surface cleaning system, wherein the cleaning head 200 comprises a retainer 202 configured as a thin pad having a non-absorbing retaining surface 204 and a non-useable surface 206 opposite to the retaining surface 204. The cleaning head 200 further comprise a surface cleaning compound 208 retained at the retaining surface 204 of the retainer 202 and formed a cleaning surface overlapped thereat.

The surface cleaning compound 208 is a polymer having high density and high adhesive ability for removing imbedded contaminants from the working surface and grabbing the contaminants therefrom.

The retainer 202 is made of non-absorbing material that prevents lubricant and the surface cleaning compound 208 being absorbed through the retainer 202. In accordance with the preferred embodiment of the present invention, the retaining surface 204 of the retainer 202 is a polyester film formed an isolation film to prevent the surface cleaning compound 208 being absorbed through the retainer 202. The retainer 202 is soft and flexible in which the retaining surface 204 can be deformed as a sponge surface to overlap on the working surface.

Therefore, the surface cleaning compound 208 will form the thin cleaning surface at the retainer 202 instead of absorbing by the retainer 202 with a thick cleaning portion. In particular, the surface cleaning compound 208 is coated on the retaining surface 204 of the retainer 202 to permanently form the cleaning surface at the retainer 202. FIG. 2 depicts the integrated structure of the surface cleaning compound 208 on the retainer 202.

The surface cleaning compound 208 is made of colloidal element, resin, abrasive element, and stabilizer, wherein a weight ratio of colloidal element, resin, abrasive element is about 25-60 wt %:10-20 wt %:15-30 wt %. The surface cleaning compound 208 further consists of a small amount of binding element and solvent.

The colloidal element of the surface cleaning compound 208 is a colloid material selected from the group consisting of silicone gel, white glue which is preferred medical used glue, hot melt adhesive, and rubber like material, wherein the colloidal element is solid and soft at room temperature and is capable of bonding with other elements to provide buffering and adhesive abilities during surface cleaning operation.

The resin of the surface cleaning compound 208 is a nature resin and is an environmental friendly material, wherein the resin is bonded with other materials to provide ability of adhesion, elasticity, and coherence.

The abrasive element of the surface cleaning compound 208 is in powdered form and is selected from the group consisting of calcium carbonate, iron oxide, alumina, silicon carbide, quartz, and carbon powders. The grain size, i.e. the diameter of the crystallized abrasive element, plays a major role, wherein the larger the grain size of the abrasive element is, the more effective the abrasive element is to remove the imbedded contaminants, especially the superficially adhesive, on the surface. On the other hand, the larger the grain size of the abrasive element is, the more easier the abrasive element scratches on the surface during the surface cleaning operation. The grain size of the abrasive element should be less than 0.1 mm. It is preferred the grain size of the abrasive element is preferred under 0.001 mm. For a vehicle surface, the grain size of the abrasive element is preferred under 0.0003 mm as the best mode.

The stabilizer of the surface cleaning compound 208 is a material with high heat capacity and is selected from the group consisting of calcium oxide, wax, alumina, and white lime. Other material having high heat capacity can also be used as the stabilizer. The role of the stabilizer is to prevent the surface cleaning compound 208 from being de-composited by the high temperature working surface, wherein the stabilizer is capable of providing lubricate, maintaining the consistency of the surface cleaning compound 208, and functioning as an insulating material for prevent any chemical change of the surface cleaning compound 208 due to the high temperature.

The binding element of the surface cleaning compound 208 is embodied as cotton fibers or silk fibers to bind with other material to minimize any crack of the surface cleaning compound 208 due to the deformation of the surface cleaning compound 208. It is noted that during surface cleaning operation, a substantial squeezing and/or stretching forces will apply to the surface cleaning compound 208, which will deform the surface cleaning compound 208. The binding element can hold the compositions of the surface cleaning compound 208 in unity to withstand the forces thereat.

The solvent of the surface cleaning compound 208 is to enhance the cohesive and adhesive ability of the surface cleaning compound 208, so that the surface cleaning compound 208 will have high density and high binding, cohesive and adhesive abilities. The solvent can also reduce the manufacturing temperature, prevent chemical change during the manufacturing process thereof, and reduce the exhaust emission during the manufacturing process of the surface cleaning compound 208.

The solvent is embodied to be natural turpentine, wherein the natural turpentine is used as the solvent to reduce the manufacturing temperature during the manufacturing process of the surface cleaning compound 208. However, the natural turpentine will provide low operation temperature during the surface cleaning operation. Therefore, the high operation temperature, such as 150° C. or above, will break down the cohesive of the other components of the surface cleaning compound 208.

Also, the solvent is embodied to be water, wherein the water is used as the solvent to enhance the operation temperature of the surface cleaning compound 208 during the surface cleaning operation. Therefore, the surface cleaning compound 208 can withstand higher operation temperature than natural turpentine. However, the manufacturing temperature of the surface cleaning compound 208 by using water as the solvent will be higher than the manufacturing temperature of the surface cleaning compound 208 by using natural turpentine as the solvent during the manufacturing process of the surface cleaning compound 208.

It is preferred that the retainer 202 is made of "Mylar". "Mylar" is a polyester film named BoPET (Biaxially-oriented polyethylene terephthalate and made from stretched polyethylene terephthalate (PET). It is used for its high tensile strength, chemical and dimensional stability, transparency, gas and aroma barrier properties and electrical insulation. It is suitable to form an isolation film and a non-absorbable film.

The cleaning head 200 further comprises a plurality of spaced apart contaminant collecting grooves 210 indented on the cleaning surface for collecting the contaminants from the working surface when the surface cleaning compound 208 grabs the contaminants from the working surface. The surface cleaning compound 208 will grab the contaminants from the working surface when the surface cleaning compound 208 contacts on the working surface during the cleaning surface. The contaminants will then be collected within the contaminant collecting grooves 210 to prevent the contaminants scratch on the working surface. The contaminants collected within the contaminant collecting grooves 210 can be rinsed off the surface cleaning compound 208 easily.

The contaminant collecting grooves 210 are longitudinally and transversely formed on the cleaning surface of the cleaning head 200, wherein the contaminant collecting grooves 210 are intersected with each other on the cleaning surface of the cleaning head 200.

Figure 3:
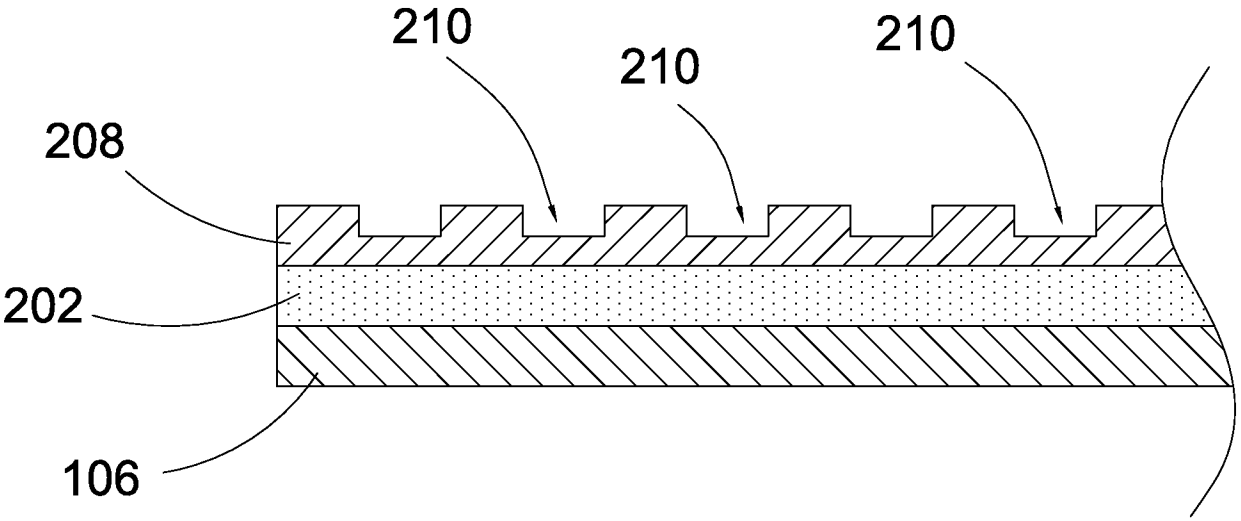
FIG. 3 shows the contaminant collecting grooves formed at the surface cleaning compound of the surface cleaning system in accordance with the present invention.

FIG. 3 depicts the contaminant collecting grooves 210 being indented and evenly formed at the surface cleaning compound 208. To form the contaminant collecting grooves 210 on the cleaning surface of the cleaning head 200, the surface cleaning compound 208 is provided at the retaining surface 204 of the retainer 202 as a flat surface. Then, a plurality of indentions is formed at the surface cleaning compound 208 to make the contaminant collecting grooves 210 thereon.

Figure 4:
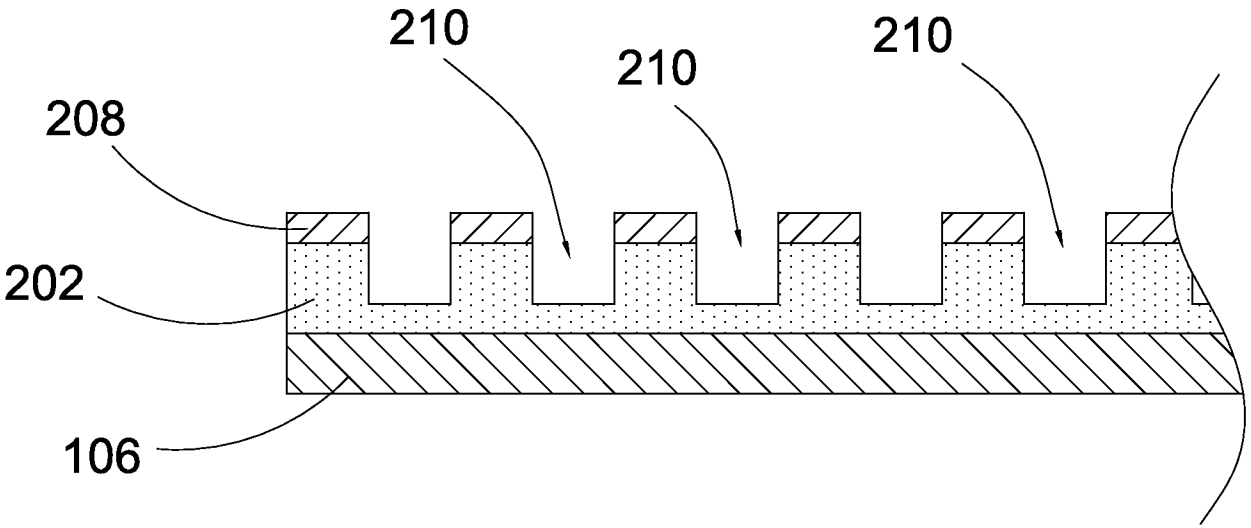
FIG. 4 shows the contaminant collecting grooves formed at the retainer of the surface cleaning system in accordance with the present invention.

FIG. 4 depicts an alternative of the formation of the contaminant collecting grooves 210, wherein a plurality of indentions is formed at the retaining surface 204 of the retainer 202 to make the contaminant collecting grooves 210 thereon. Then, the surface cleaning compound 208 is applied at the retaining surface 204 of the retainer 202 without covering the contaminant collecting grooves 210. Therefore, the contaminant collecting grooves 210 are indented and evenly formed at the retaining surface 204 of the retainer 202 that the surface cleaning compound 208 is retained at the retaining surface 204 of the retainer 202 without covering the contaminant collecting grooves 210.

FIGS. 1 and 2 depict the cleaning head 200 being affixed to the applicator 100, wherein the applicator 100 is arranged to guide the retainer 202 and the surface cleaning element 208 in position in order to clean the working surface. The applicator 100 comprises a compressible body 102. The compressible body 102 is preferred to detachably attach to the non-useable surface 206 of the retainer 202 via an attaching unit 104 for enabling a compressing force evenly exerted at the cleaning surface through the compressible body 102. It is preferred that the compressible body 102 is made of spongy material or the like which can be deformed to evenly transfer the compressing force at the cleaning surface. It is noted that the retainer 202 forms the isolation film to prevent the surface cleaning compound 208 being soaked by the compressible body 102 through the retainer 202 even though the compressible body 102 is made of sponge. When lubricant is applied on the working surface, the retainer 202 will prevent the lubricant being soaked by the compressible body 102 as well in order to maximize the usage of the lubricant.

The attaching unit 104 is used for detachably attaching the compressible body 102 to the non-useable surface 206 of the retainer 200. The attaching unit 104 comprises a first fastener 106 provided at the compressible body 102 and a second fastener 108 provided at the non-useable surface 206 of the retainer 202. Therefore the first and second fasteners 104 and 106 are detachably fastened together to detachably attach the retainer 202 on the compressible body 102. It is preferred that the first and second fasteners 104 and 106 are Velcro, i.e. hook and loops fasteners.

It is noted that the cleaning head 200 is replaceable in which once the surface cleaning compound 208 is used up, the user is able to replace a new cleaning head 200 by detaching the cleaning head 200 from the retainer 200 via the attaching unit 104.

FIG. 1 depicts the applicator 100 as a machine powered device, wherein the applicator 100 further comprises a machine buffering device 110 and a dual action adapter pad 112 coupled between the machine buffering device 106 and the compressible body 102 that enables a machine cleaning operation.

The machine buffer device 110 can be a machine polisher to provide a particular movement or action the machine produces. The machine buffer device 110 can be an orbital polisher device providing single action that the cleaning head 200 will move in one repeating direction and mimic the tight circles of a hand. The machine buffer device 110 can be a rotary polisher providing single action but acts to spin the cleaning head 200 at a high rate. The machine buffer device 110 can also be a dual-action polisher which combines the tight circles of an orbital polisher with the spinning motion of the rotary polisher. It is preferred that the dual-action polisher is used since it can be random in nature, i.e. the spinning of the cleaning head 200 is controlled by physics, or forced rotation, where the cleaning head 200 is mechanically driven to spin.

It is appreciated that a lubricant container is supported by the applicator 100 for containing the lubricant and a dispensing tube is extended from the lubricant container to the cleansing surface for dispensing the lubricant at the working surface.

The dual action adapter pad 112 is a soft edge dual action pad detachably coupled with the machine buffer device 110. It is preferred that the attaching unit 104 is also provided between the compressible body 102 and the dual action adapter pad 112 that enables the compressible body 102 being detached from the dual action adapter pad 112 for cleaning purpose.

FIG. 1 also depicts the second fastener 108 is also provided at the compressible body 102 and the first fastener 106 is also provided at the dual action adapter pad 112. Therefore, the compressible body 102 with the first fastener will form an interfacing unit to couple between the dual action adapter pad 108 and the cleaning head 200.

Figure 5:
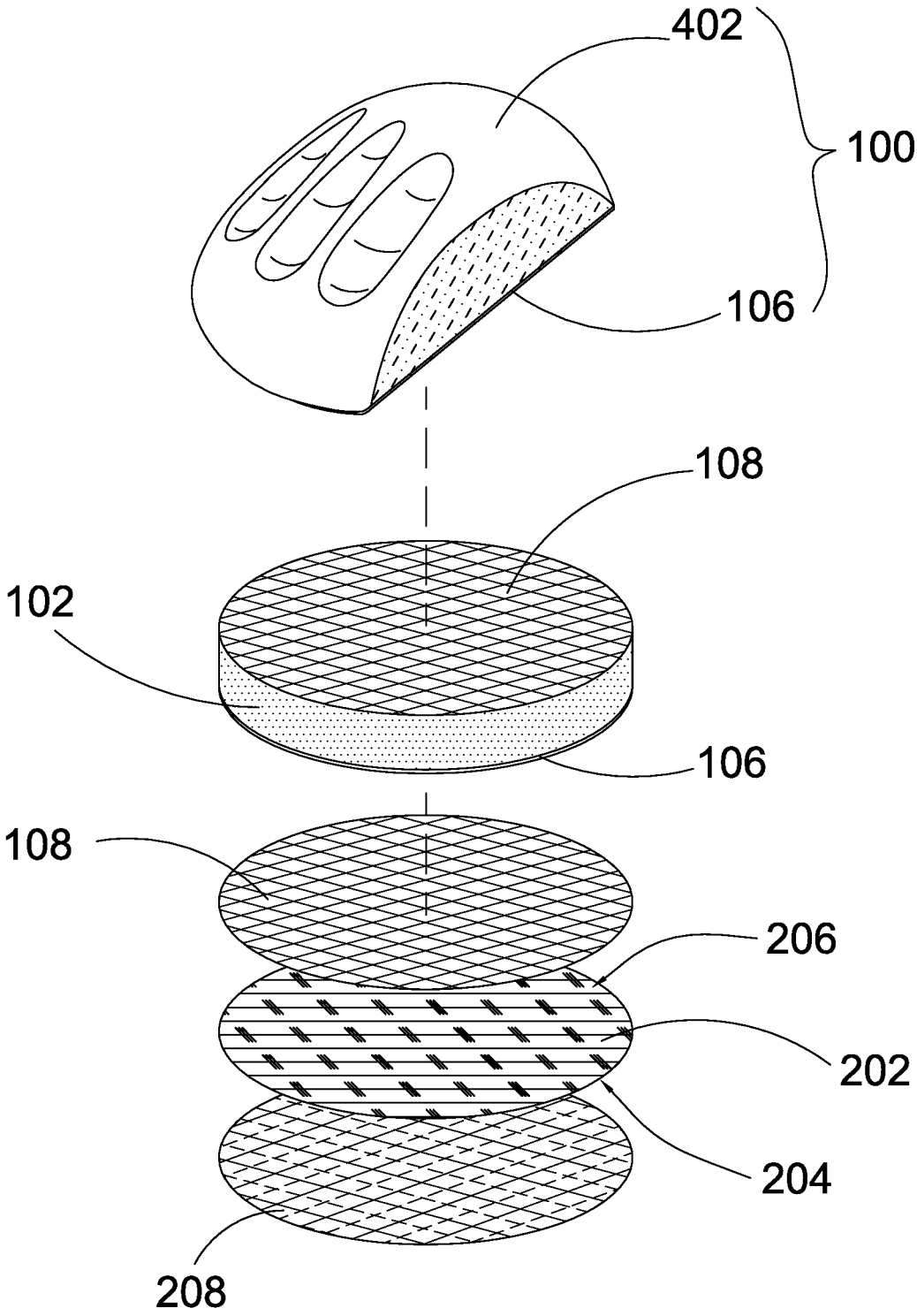
FIG. 5 is a schematic view of a surface cleaning system in accordance with the present invention, showing the applicator being configured as a hand held applicator.

FIG. 5 depicts the applicator 400 as a hand held actuator 402 mounting to the cleaning head 200 that enables a manual cleaning operation by hand, wherein the hand held actuator 402 can be gripped by the user hand to generate a movement or action with the tight circles at the cleaning head 200.

The cleaning head 200 can be directly affixed to the hand held actuator 402. FIG. 5 depicts the second fastener 108 is provided at the hand held actuator 402 to detachably fasten the first fastener 106 at the retainer 202.

The cleaning head 200 can also be indirectly affixed to the hand held actuator 402 through the compressible body 102. Therefore, the compressible body 102 can be sandwiched between the cleaning head 200 and the hand held actuator 402 to evenly distribute the force at the cleaning head 200.

FIG. 5 depicts the first fastener 104 is also provided at the compressible body 102 and the second fastener 106 is also provided at the hand held actuator 402 that enables the compressible body 102 being detached from the hand held actuator 402.

Figure 6:
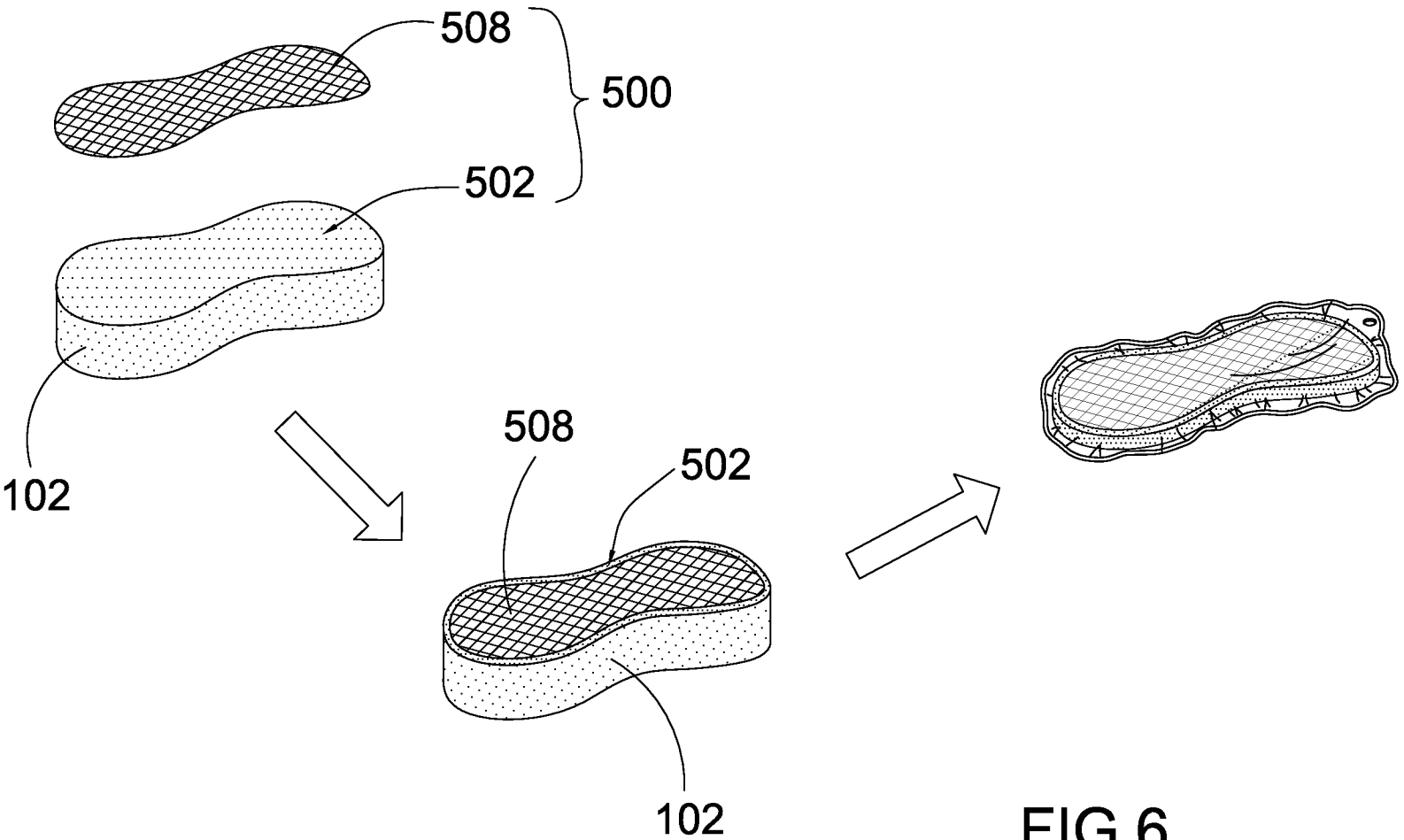
FIG. 6 is a schematic view of a surface cleaning system in accordance with the present invention, showing the retainer integrated between the surface cleaning compound and the compressible body, wherein the compressible body is embodied to be a sponge.

FIG. 6 depicts an alternative of the cleaning head 500, wherein the retainer 502 is a coating layer coated at the compressible body 102. Therefore, the cleaning head 500 is integrated with the compressible body 102 that the retainer 502 is integrated between the surface cleaning compound 508 and the compressible body 102. The compressible body 102 can be a sponge in FIG. 6 that the retainer 502 is integrated on the sponge of the compressible body 102 so that the surface cleaning compound 508 can be integrated with the compressible body 102 through the retainer 502. The retainer 502 can be sprayed or coated on the compressible body 102 to form a thin isolation film thereon and the surface cleaning compound 508 is coated on the retainer 502. The retainer 502 does not require being coated on the entire surface of the compressible body 102, wherein at least a portion of the surface of the compressible body 102 is coated by the retainer 502 to minimize the surface cleaning compound 508 being absorbed by the compressible body 102. The thickness of the retainer 502 can be altered when the retainer 502 is coated on the compressible body 102.

Figure 7:
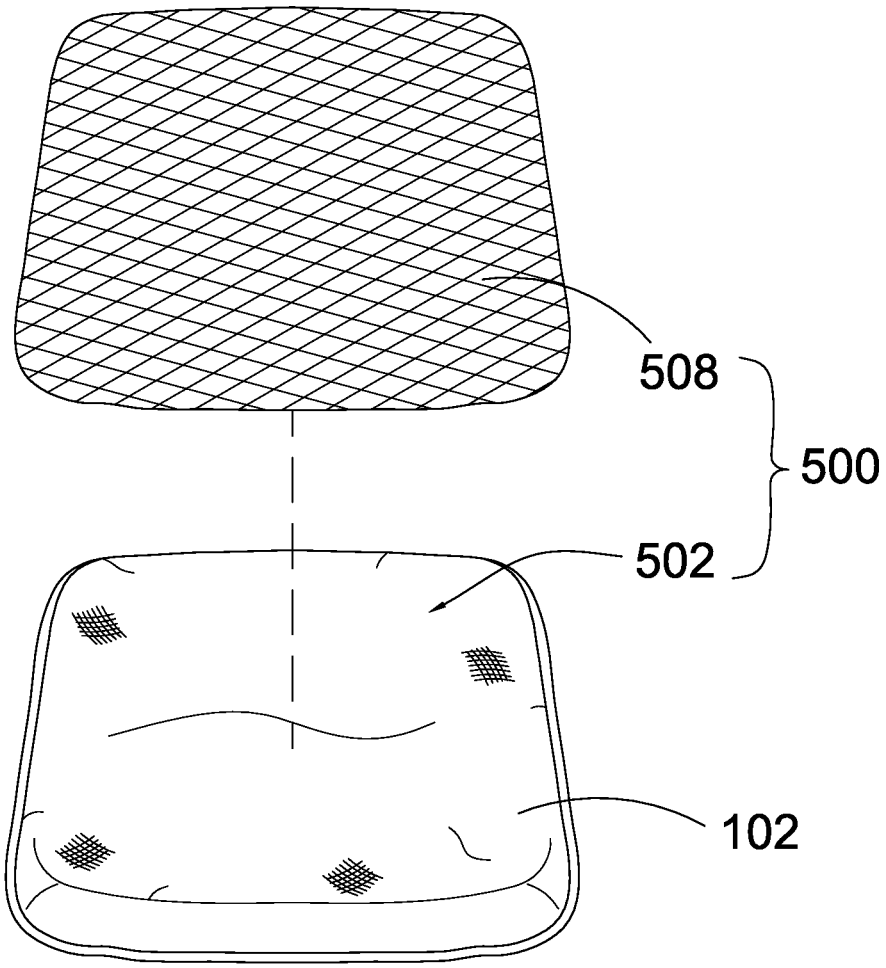
FIG. 7 is a schematic view of a surface cleaning system in accordance with the present invention, showing the retainer integrated between the surface cleaning compound and the compressible body, wherein the compressible body is embodied to be a microfiber towel.

The compressible body 10 can be a microfiber towel in FIG. 7 that the retainer 502 is integrated on the microfiber towel of the compressible body 102 so that the surface cleaning compound 508 can be integrated with the compressible body 102 through the retainer 502. The integrated structure can be formed in one piece and be vacuum-sealed.

For using the surface cleaning system to clean the working surface, the lubricant can be initially applied between the working surface and the cleaning surface of the cleaning head 200. By applying a motion at the applicator to generate a polishing force at the cleaning head 200, the cleaning surface contacts with the working surface that the imbedded contaminants at the working surface will be efficiently removed with damaging the working surface. It is preferred that the lubricant is a high density lubricant, wherein the high density lubricant has a lubricating ability better than water.

While the embodiments and alternatives of the present invention have been shown and described, it will be apparent to one skilled in the art that various other changes and modifications can be made without departing from the spirit and scope of the present invention.

What is claimed is:

1. A surface cleaning system comprising:

a retainer having a non-absorbing retaining surface and a surface cleaning compound retained at said retaining surface of said retainer and forming a cleaning surface overlapped thereat for preventing lubricant and said surface cleaning compound from being absorbed through said retainer, wherein said surface cleaning compound is a polymer having high density and high adhesive ability for removing imbedded contaminants from a working surface and grabbing said contaminants therefrom;

an applicator for guiding said retainer in position, wherein said applicator comprises a compressible body attaching to a non-useable surface of said retainer for enabling a compressing force to be evenly exerted at said cleaning surface through said compressible body; and an attaching means for detachably attaching said compressible body to said non-useable surface of said retainer, wherein said attaching means comprises a first fastener provided at said compressible body and a second fastener provided at said non-useable surface of said retainer, wherein said first and second fasteners are detachably fastened together to detachably attach said retainer on said compressible body.

2. The surface cleaning system of claim 1 wherein said applicator further comprises a hand held actuator mounting to said compressible body that enables a manual cleaning operation by hand, wherein said attaching means is also provided between said compressible body and said hand held actuator that enables said compressible body being detached from said hand held actuator.

3. The surface cleaning system of claim 1 wherein said applicator further comprises a machine buffering device and a dual action adapter pad coupled between said machine buffering device and said compressible body that enables a machine cleaning operation, wherein said attaching means is also provided between said compressible body and said dual action adapter pad that enables said compressible body being detached from said dual action adapter pad.

4. A surface cleaning system comprising:

a retainer having a non-absorbing retaining surface and a surface cleaning compound retained at said retaining surface of said retainer and forming a cleaning surface overlapped thereat for preventing lubricant and said surface cleaning compound from being absorbed through said retainer, wherein said retainer is a thin pad and is made of BoPET, wherein said surface cleaning compound is a polymer having high density and high adhesive ability for removing imbedded contaminants from a working surface and grabbing said contaminants therefrom, wherein said surface cleaning compound is coated on said retaining surface of said retainer, and wherein said retaining surface of said retainer is a polyester film forming an isolation film to prevent said surface cleaning compound being absorbed through said retainer;

an applicator for guiding said retainer in position, wherein said applicator comprises a compressible body attaching to a non-useable surface of said retainer at said compressible body for enabling a compressing force to be evenly exerted at said cleaning surface through said compressible body; and an attaching means for detachably attaching said compressible body to said non-useable surface of said retainer, wherein said attaching means comprises a first fastener provided at said compressible body and a second fastener provided at said non-useable surface of said retainer, wherein said first and second fasteners are detachably fastened together to detachably attach said retainer on said compressible body.

5. The surface cleaning system of claim 4 wherein said applicator further comprises a hand held actuator mounting to said compressible body that enables a manual cleaning operation by hand, wherein said attaching means is also provided between said compressible body and said hand held actuator that enables said compressible body being detached from said hand held actuator.

6. The surface cleaning system of claim 4 wherein said applicator further comprises a machine buffering device and a dual action adapter pad coupled between said machine buffering device and said compressible body that enables a machine cleaning operation, wherein said attaching means is also provided between said compressible body and said dual action adapter pad that enables said compressible body being detached from said dual action adapter pad.

7. A surface cleaning system comprising:

a retainer having a non-absorbing retaining surface and a surface cleaning compound retained at said retaining surface of said retainer and forming a cleaning surface overlapped thereat for preventing lubricant and said surface cleaning compound from being absorbed through said retainer, wherein said retainer is a thin pad and is made of BoPET, wherein said surface cleaning compound is a polymer having high density and high adhesive ability for removing imbedded contaminants from a working surface and grabbing said contaminants therefrom, wherein said surface cleaning compound is coated on said retaining surface of said retainer, and wherein said retaining surface of said retainer is a polyester film forming an isolation film to prevent said surface cleaning compound being absorbed through said retainer;

a plurality of spaced apart contaminant collecting grooves indented on said clean surface for collecting said contaminants from said working surface when said surface cleaning compound grabs said contaminants from said working surface:

an applicator for guiding said retainer in position, wherein said applicator comprises a compressible body attaching to a non-useable surface of said retainer at said compressible body for enabling a compressing force to be evenly exerted at said cleaning surface through said compressible body; and an attaching means for detachably attaching said compressible body to said non-useable surface of said retainer, wherein said attaching means comprises a first fastener provided at said compressible body and a second fastener provided at said non-useable surface of said retainer, wherein said first and second fasteners are detachably fastened together to detachably attach said retainer on said compressible body.

8. The surface cleaning system of claim 7 wherein said applicator further comprises a hand held actuator mounting to said compressible body that enables a manual cleaning operation by hand, wherein said attaching means is also provided between said compressible body and said hand held actuator that enables said compressible body being detached from said hand held actuator.

9. The surface cleaning system of claim 7 wherein said applicator further comprises a machine buffering device and a dual action adapter pad coupled between said machine buffering device and said compressible body that enables a machine cleaning operation, wherein said attaching means is also provided between said compressible body and said dual action adapter pad that enables said compressible body being detached from said dual action adapter pad.

* * * * *